US008003905B2

(12) United States Patent
Kuehner et al.

(10) Patent No.: US 8,003,905 B2
(45) Date of Patent: Aug. 23, 2011

(54) FOOT SWITCH FOR ELECTROMEDICAL APPARATUS AND METHOD OF MANUFACTURING SUCH A FOOT SWITCH

(75) Inventors: Ralf Kuehner, Stuttgart (DE); Roland Hundt, Tübingen (DE)

(73) Assignee: ERBE Elektromedizin GmbH, Tübingen (DE)

( * ) Notice: Subject to any disclaimer, the term of this patent is extended or adjusted under 35 U.S.C. 154(b) by 308 days.

(21) Appl. No.: 11/921,297

(22) PCT Filed: May 24, 2006

(86) PCT No.: PCT/EP2006/004983

§ 371 (c)(1),
(2), (4) Date: Nov. 29, 2007

(87) PCT Pub. No.: WO2006/128630

PCT Pub. Date: Dec. 7, 2006

(65) Prior Publication Data

US 2009/0205937 A1 Aug. 20, 2009

(30) Foreign Application Priority Data

May 30, 2005 (DE) ..... 10 2005 024 669
Jun. 24, 2005 (DE) ..... 10 2005 029 458

(51) Int. Cl.
*H01H 3/14* (2006.01)

(52) U.S. Cl. ..... 200/86.5; 433/101

(58) Field of Classification Search ..... 200/86.5, 200/322, 332; 433/101
See application file for complete search history.

(56) References Cited

U.S. PATENT DOCUMENTS

| | | | | |
|---|---|---|---|---|
| 5,422,521 | A * | 6/1995 | Neer et al. | 307/119 |
| 6,040,537 | A * | 3/2000 | McClintock | 200/86.5 |
| 7,118,693 | B2 * | 10/2006 | Glatkowski et al. | 252/502 |
| 7,270,882 | B2 * | 9/2007 | Wang | 428/412 |

FOREIGN PATENT DOCUMENTS

| | | |
|---|---|---|
| CN | 2133042 | 5/1993 |
| DE | 88 10 751 | 10/1988 |
| DE | 40 05 059 | 10/1990 |
| DE | 197 40 382 | 3/1999 |
| DE | 198 01 152 | 7/1999 |
| DE | 200 19 995 | 3/2001 |
| DE | 201 05 851 | 10/2001 |
| DE | 100 57 589 | 7/2002 |
| DE | 203 11 296 | 10/2003 |
| EP | 1 243 223 | 9/2002 |
| WO | WO 94/10962 | 5/1994 |
| WO | WO 2004/019751 | 3/2004 |

OTHER PUBLICATIONS

Steute Schaltgeräte GMBH: "Medizinetechnik// Stelleinrichtungen für die medizine" pp. 1-74, Nov. 2004.

* cited by examiner

*Primary Examiner* — Edwin A. Leon
*Assistant Examiner* — Vanessa Girardi
(74) *Attorney, Agent, or Firm* — Dickstein Shapiro LLP

(57) ABSTRACT

An actuating device for an electromedical apparatus and in particular a foot switch. The foot switch includes a floor part, at least one pedal part that is tiltably connected to the floor part, and at least one switch element that is actuated by the pedal part. Further, at least the floor part is manufactured by one of an extrusion-coating method or a casting method such that at least a portion of the floor part is fully coated by a coating material.

15 Claims, 7 Drawing Sheets

FOOT SWITCH FOR ELECTROMEDICAL APPARATUS AND METHOD OF MANUFACTURING SUCH A FOOT SWITCH

FIELD OF THE INVENTION

The invention relates to an actuating device for an electromedical apparatus, and in particular to a foot switch. The invention also relates to a method of manufacturing such an actuating device.

BACKGROUND OF THE INVENTION

An actuating device (e.g., a foot switch) that is a floor switch with a floor part, at least one pedal part that is tiltably connected to the floor part, and at least one switch element that can be actuated by the pedal part is described, for example, in DE 100 57 589 C1.

Foot switches for an electromedical apparatus must satisfy high demands regarding hygiene. In particular, it must be possible to effectively disinfect such foot switches, in order to reduce the risk of infection in operation rooms. Conventional foot switches, such as are known, for example, in DE 4 005 059 C2 and DE 198 01 152 A1 have the problem that the pedal bearing provided for the tilting movement of the pedal is made of several components. Because of the multipart construction of the bearing, it is difficult to clean and/or disinfect these conventional foot switches thoroughly.

An improvement with respect to effective disinfection is provided by the foot switch disclosed in DE 100 57 589 C1, which represents the foundation of this generic category. The foot switch disclosed therein consists of a pedal part that is tiltably connected to a floor part, such that a switch element fixed to the floor part can be activated by the pedal part. The switch element then sends a corresponding actuation signal to an electromedical apparatus connected to the foot switch, for example a high frequency electrode. The pedal bearing of this foot switch comprises a repositioning means, which moves the pedal back to the initial position following actuation, as well as a joint that enables the tilting movement of the pedal. In this foot switch the repositioning means and the joint are combined to form an elastic joint unit, which is, for example, constructed as a flexible conical element, one side of which is connected to the floor part and the other side of which is connected to the pedal part. The presence of the flexible conical element considerably simplifies cleaning of the foot switch.

The whole foot switch must be designed as a completely washable product so that it can be thoroughly disinfected. Its construction thus requires great effort and expense, based in particular on the choice of material and the elaborate sealing needed for screwed cable connections, activation elements and pedal bearings. Even though the above-mentioned foot switch known from DE 100 57 589 C1 does bring an improvement regarding cleaning of the pedal bearing, the effort of construction is still considerable with regard to the washability of the complete foot switch.

It is thus the objective of the present invention to improve an actuating device in such a way that the washability of the entire actuating device is achieved by comparatively simple means. Furthermore, a method of manufacturing such an actuating device is to be disclosed.

BRIEF DESCRIPTION OF THE DRAWINGS

The invention is described with reference to exemplary embodiments, which are explained in greater detail with reference to the drawings, wherein.

DETAILED DESCRIPTION OF THE INVENTION

Figure 1:
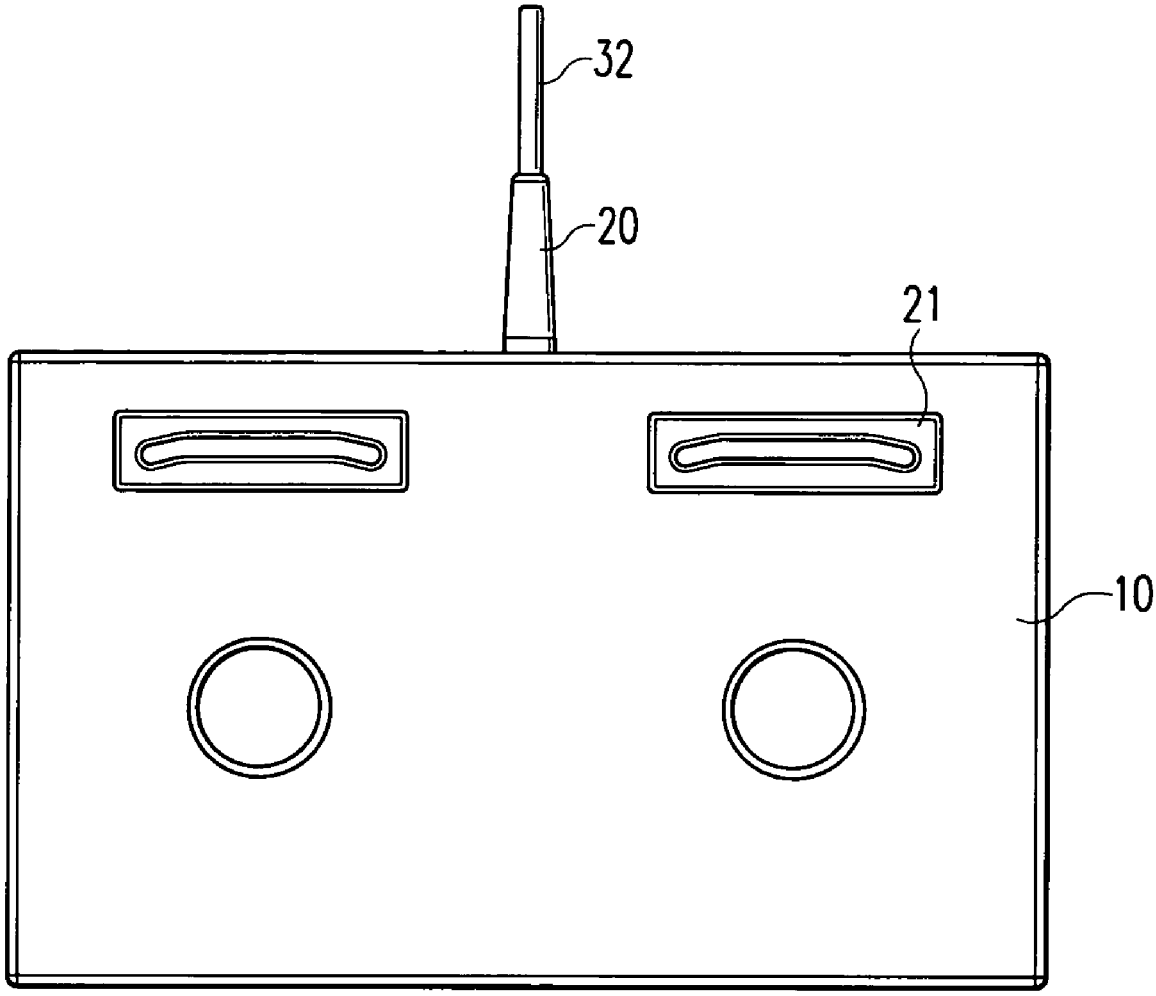
FIG. 1 is a plan view of the floor part of a foot switch in accordance with a disclosed embodiment.

The invention provides a foot switch that includes a floor part, at least one pedal part tiltably connected to the floor part, and at least one switch element that can be actuated by the pedal part, such that at least the floor part can be produced by an extrusion-coating method or a casting method.

Disclosed embodiments offer the advantage that all components of the floor part, i.e. both the mechanical and electrical components, are coated or encapsulated by the extrusion-coating or casting method, so that the sealing of special components (such as e.g., screwed cable connections or activation elements) is largely eliminated. Moreover, such an actuating device is able to be manufactured relatively inexpensively, because the shaping of the floor part can be done in a single step by extrusion-coating or casting. However, it should be noted that a multiple-step process is not excluded from the scope of the invention. The encased floor part is substantially hermetically sealed and therefore satisfies the requirements IPX8 according to the normative specifications from EN 60601-1 or IIC 529 (EN 60529) for medical devices.

Preferably the floor part comprises at least one carrier element, which is at least partially enclosed by an extrusion-coating or casting material that is substantially matched to the contour of the carrier element. The carrier element provides adequate stability both during the manufacturing process and in the finished component.

The switch element or other functional elements may also be attached to or located within the carrier element, so that the carrier element not only stabilizes the device but also serves as a holder or receptacle for functional elements.

The switch element may include a membrane keypad composite disposed in a recess in the carrier element in such a way that the membrane keypad composite is accessible for actuation by the pedal part. The design of the switch element as a membrane keypad composite has the advantage that a comparatively large activation surface can be made available, for example one measuring ca. 30×20 mm. Furthermore, the membrane keypad composite is flat and therefore can be easily processed as part of the extrusion-coating or casting procedure.

The switch element can further include an electronic evaluation means connected to the membrane keypad composite and disposed in an additional recess within the carrier part. The additional recess is formed on a side of the carrier element opposite the membrane keypad composite. This results in a compact and stable construction of the actuating device, in which the electronic evaluation means is securely disposed in the coated carrier element on the side that faces downward when in use.

The switch element may include microswitches, reed switches and/or switches that incorporate Hall sensors, capacitive sensors and/or inductive sensors. This provides a broad spectrum of uses for the actuating device, in particular with respect to the non-contact switches, which enable a complete coating of the floor part.

In another preferred embodiment, a pedal beating and/or an anti-kink sleeve is formed so as to be integral with the floor part, in particular with the extrusion-coating or casting material that encloses the carrier element. Because of the integral construction, there is no need to provide a special sealing means for these components.

The pedal bearing may include a pedestal with a bearing surface for the pedal part that is disposed substantially horizontally when in use. This embodiment is particularly suitable for a pedal bearing that is integral with the floor part, in particular with the extrusion-coating or casting material that surrounds the carrier element.

A simple means of connecting the pedal part to the floor part is available if the pedestal comprises at least one through-bore which is vertically oriented, while the apparatus is in use, and through which is passed a connecting means that can serve to fasten the pedal part to the floor part.

The anti-kink sleeve can be associated with a cable holder integrated with extrusion-coating or casting material, so that the electrical cable that leaves the actuating device is protected against mechanical tensile forces.

The carrier element can comprise at least one opening in the region of the tiltable connection between floor part and pedal part. This opening can be covered with extrusion-coating material in the course of the extrusion-coating or casting process, in such a way that a passageway is provided in the material in a position concentric with the opening in the carrier element. This passageway can be used in particular to arrange the connecting means.

It is advantageous for two, three or more pedal parts to be provided, disposed in parallel and/or at an angle to one another. With such an actuating device, various functions can be carried out, for example coagulation or cutting with a high frequency electrode, each function being assigned to a separate pedal part.

FIG. 1 shows a floor part for an actuating device for an electromedical apparatus, in particular for a foot switch, that can be manufactured by an extrusion-coating process or a casting process. To produce the floor part 10, any known extrusion-coating or casting process may be used, the crucial aspect being that the floor part, at least in one or more regions thereof, is fully coated by or encapsulated within the extrusion-coating or casting material, so that a substantially fluid-tight and media-resistant housing is formed. It is not necessary for the floor part to be completely encapsulated, however, complete encapsulation provides especially good results. It is also possible to leave out certain regions of the floor part and to seal the edges of such an uncoated region separately. Further details in this regard will be given below.

Figure 7:
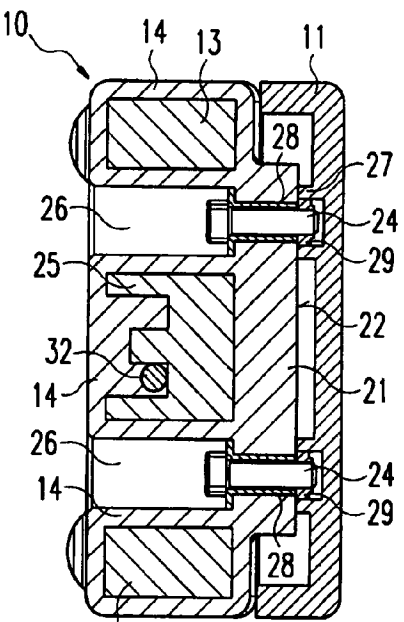
FIG. 7 shows a section through the foot switch according to FIG. 5 along the line B-B.
Figure 6:
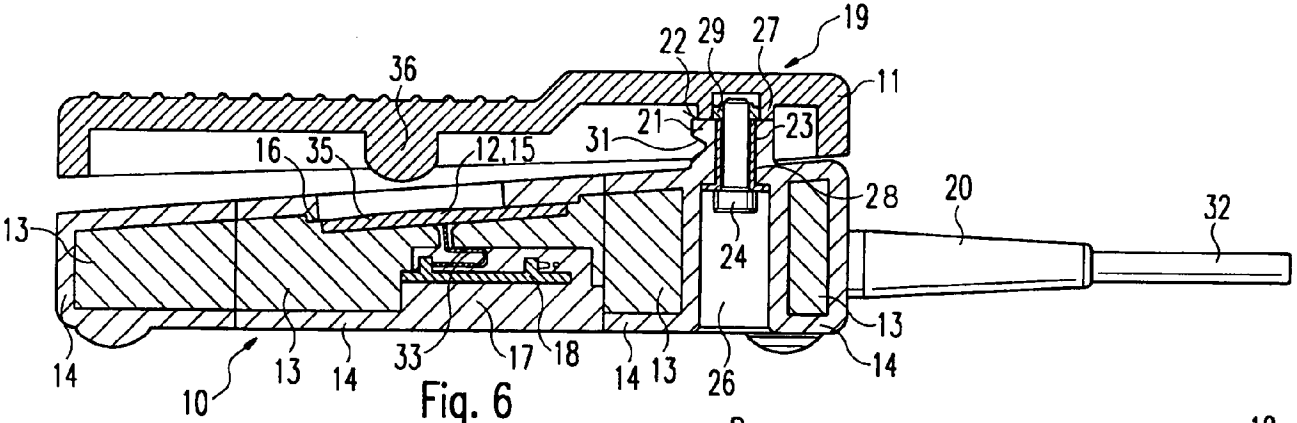
FIG. 6 shows a section through the foot switch according to FIG. 5 along the line A-A.
Figure 5:
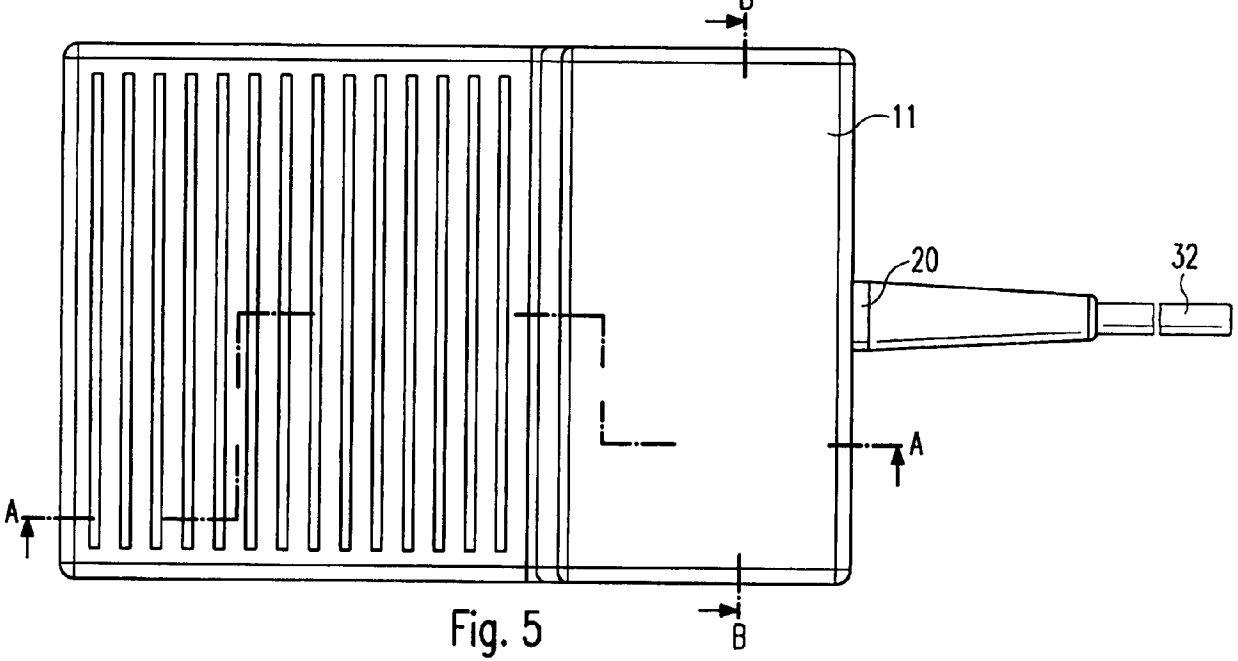
FIG. 5 is a plan view of the foot switch according to FIG. 4.

To manufacture the floor part 10 a carrier element 13, such as is illustrated for example in FIGS. 6 and 7, is coated by a casting or extrusion-coating (overmould) process with a material such as thermoplastic polyurethane, which is obtainable under the brand names DESMOPAN® or TEXIN®. The carrier element 13 is thereby enclosed in the coating material 14 in such a way that the material conforms substantially to the contour of the carrier element 13, and follows the profile of the carrier element 13. This results in the walls of the carrier element 13 being coated with a layer of coating material 14 that has a substantially uniform thickness, but does not exclude the possibility that the coating material in some places or regions has a profile that departs from the profile of the carrier element 13. For instance, this can be the case in the region of the pedal bearing 19 or in the region of the sleeve 20, which will be discussed further below. The coating material 14 is closely apposed to the carrier element 13 and thus forms an outer skin or a housing that is firmly connected to the carrier element 13. The shape of the floor part 10 is thus determined substantially by the shape of the carrier element 13.

Because the extrusion-coating process is used, the final form of the product is obtained substantially without additional processing steps, so that the shaping of the product is achieved during the extrusion-coating or casting. Furthermore, a hermetic sealing, with regard to the requirement IPX8, is thereby obtained for the housing as well as the linkage point for the pedal part 11 and the sleeve 20, the feet of the device and in some cases also other functional elements. Furthermore, by selection of a suitable material for the casting or extrusion-coating process, e.g. selection of a thermoplastic polyurethane, the requirements for washability are taken into account by simple means, in particular with respect to thermal and media stability.

An exemplary embodiment of an actuating device, in particular a foot switch in accordance with the invention, is presented in FIGS. 6 and 7.

The floor part 10 of the device consists of a carrier element 13 that at least in sections is covered by an extrusion-coating material 14. The carrier element 13 is constructed in a wedge shape, such that its cross section decreases from the end of the carrier element 13 that incorporates the pedal bearing 19 to the distal end. The foot switch further comprises a pedal part 11 that is pivotably connected to the floor part 10 by way of the pedal bearing 19. The pedal bearing 19 comprises for this purpose a pedestal 21 that includes a bearing surface 22 for the pedal part 11. When in use, this bearing surface 22 is oriented substantially horizontally. As shown in FIG. 7, as well as in FIGS. 1, 3 and 4, the pedestal 21 extends substantially transverse to the longitudinal extent of the floor part 10. As can be seen in FIGS. 6 and 7, the pedestal 21 is formed so as to be integral with the extrusion-coating material 14 that encloses at least some regions of the carrier element 13. It is also possible for the pedestal 21 to be constructed as a separate component that is then connected to the extrusion-coating material 14, for example by adhesive or screws. The one-piece variant shown in FIGS. 6 and 7 is particularly economical. The pedal part 11 includes a counterpart 27 that is constructed in correspondence with the pedestal 21 and is seated on the bearing surface 22 of the pedestal 21 when in use. The counterpart 27 is constructed, for example, as a circular or annular projection formed integrally on the pedal part 11. The pedal part 11 is fixed to the floor part 10 by a connecting means 24, for example a screw that passes through a through-bore 23 in the pedestal 21. The through-bore 23 is oriented substantially vertically and opens into the bearing surface 22. Within the through-bore 23 is disposed a sheath 28 through which the screw is guided. The screw is fixed by a nut or by a ring 29 situated in the interior of the counterpart 27, i.e. the projection, and connects the pedal part 11 to the floor part 10. This connection allows a tilting movement because of the elasticity of the pedestal material and/or of the pedal material in the region of the pedal bearing 19. Because of the wedge-shaped construction of the floor part 10, it is ensured that the pedal part 11 and the floor part 10 are spaced apart by a distance required for the tilting movement of the pedal part 11.

The tilting movement of the pedal part 11 is additionally assisted by a wedge-shaped notch 31 provided in the pedestal, which runs parallel to the upper surface of the floor part 10, on the side of the pedestal 21 that faces the distal end of the floor part 10. The notch 31 enables a certain degree of compression and deformation of the pedestal material in this region.

Figure 2B:
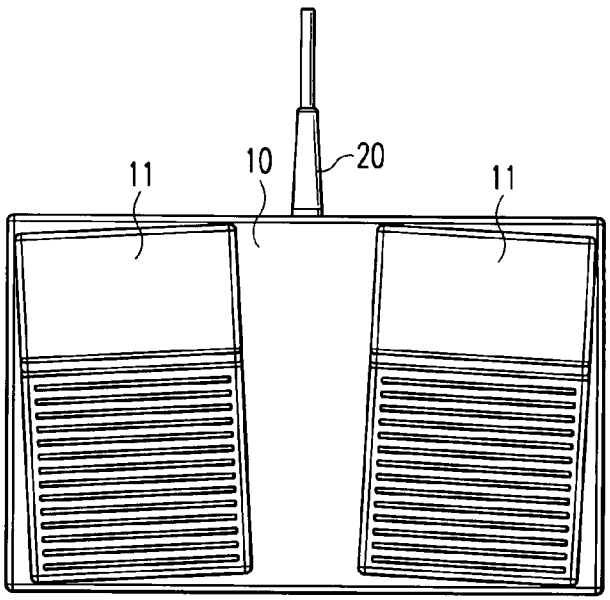
FIGS. 2*a*, 2*b*, 2*c* are plan views of foot switches with differently disposed pedal parts in accordance with a disclosed embodiment.
Figure 2C:
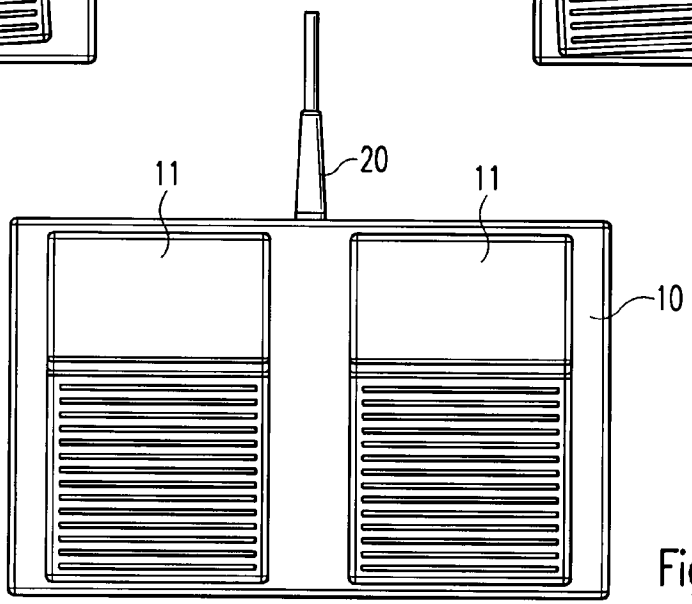
Figure 2A:
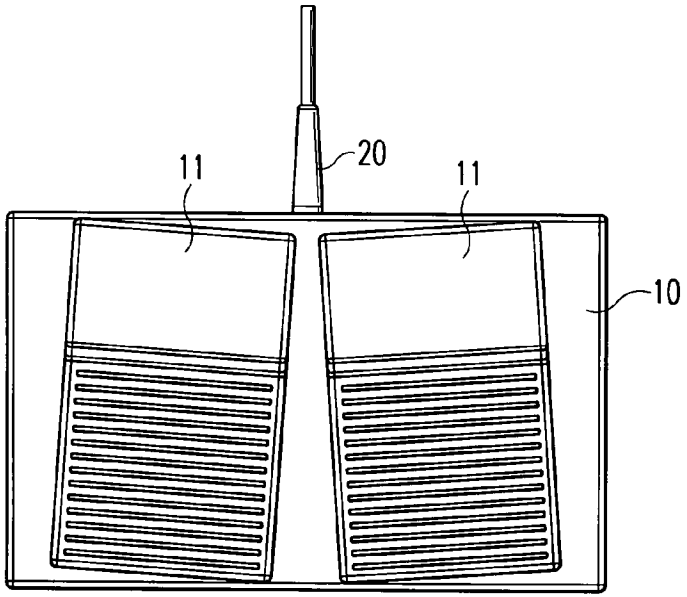
Figure 3:
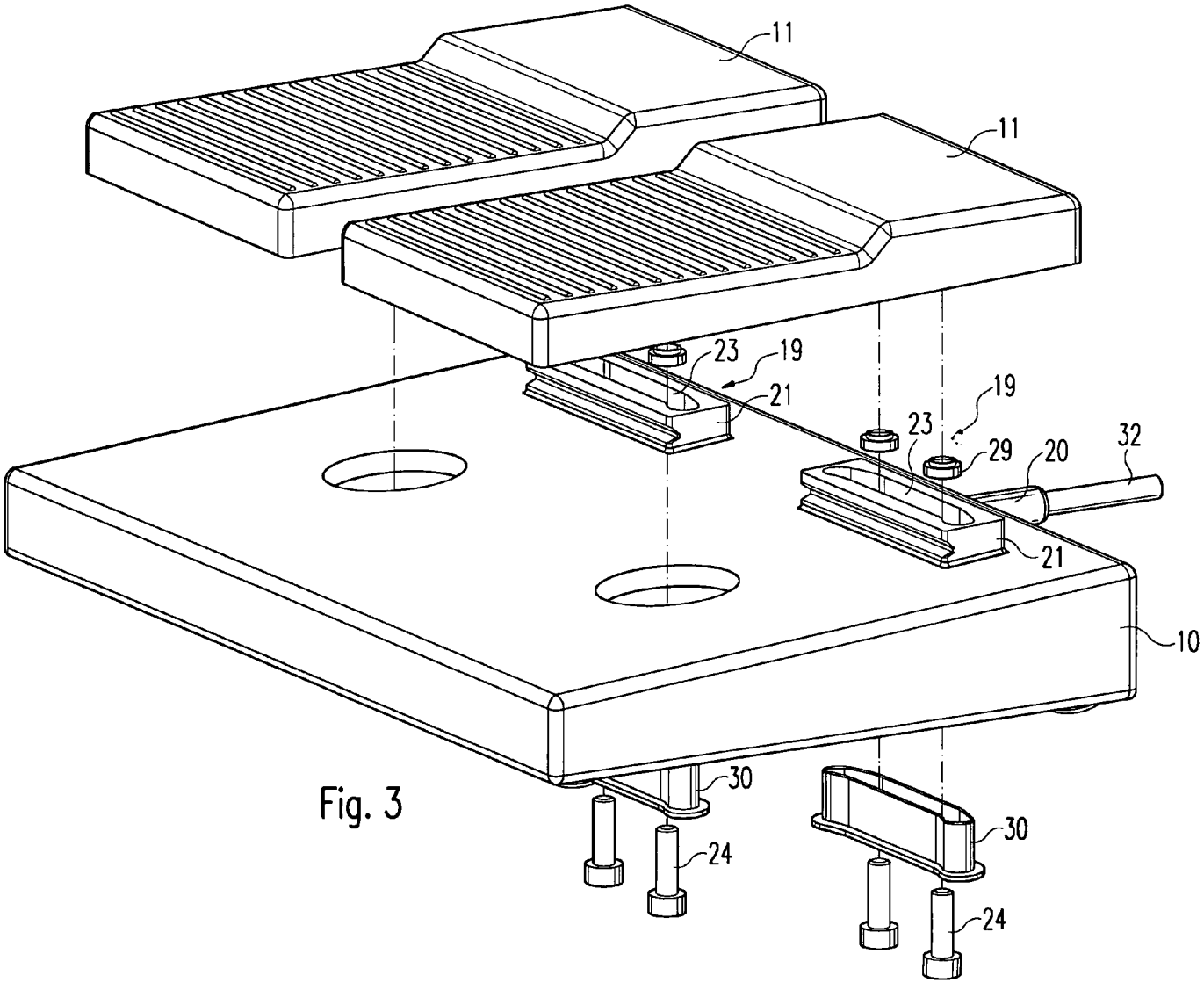
FIG. 3 is an exploded drawing of a foot switch with two pedals in accordance with a disclosed embodiment.
Figure 4:
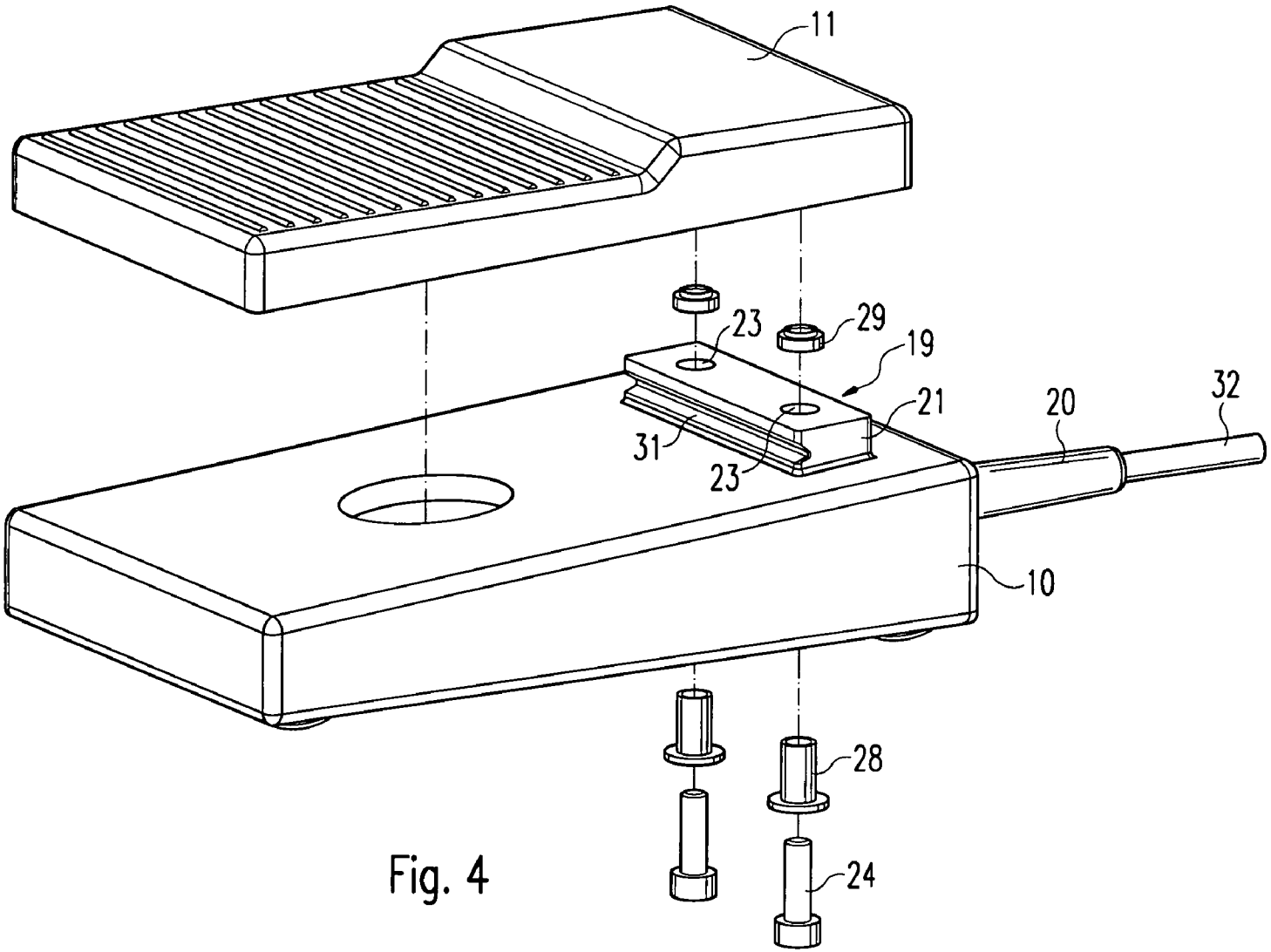
FIG. 4 is an exploded drawing of a single-pedal foot switch in accordance with a disclosed embodiment.

As shown in particular in FIG. 4, the through-bores 23 in the pedestal 21 may be circular, two such bores 23 being provided per pedestal 21. Alternatively, as shown in FIG. 3, in particular in the case of the two-pedal foot switch, the through-bores 23 may be oblong rather than circular, in which case one bore 23 or opening is provided per pedestal 21. A correspondingly elongated insert 30 is provided in the opening to guide the screws or the connecting means 24. The oblong bore 23 (slot) makes it possible to adjust the connection site between the floor part 10 and the pedal part 11, so as to alter the orientation of the pedal part 11 on the floor part 10. By suitably shifting the connecting means 24 within the insert 30, the pedal parts 11 can be adjusted to the parallel or angled arrangements shown in FIGS. 2*a*, 2*b* and 2*c*, in accordance with the individual preferences of the user of the foot switch.

Figure 8:
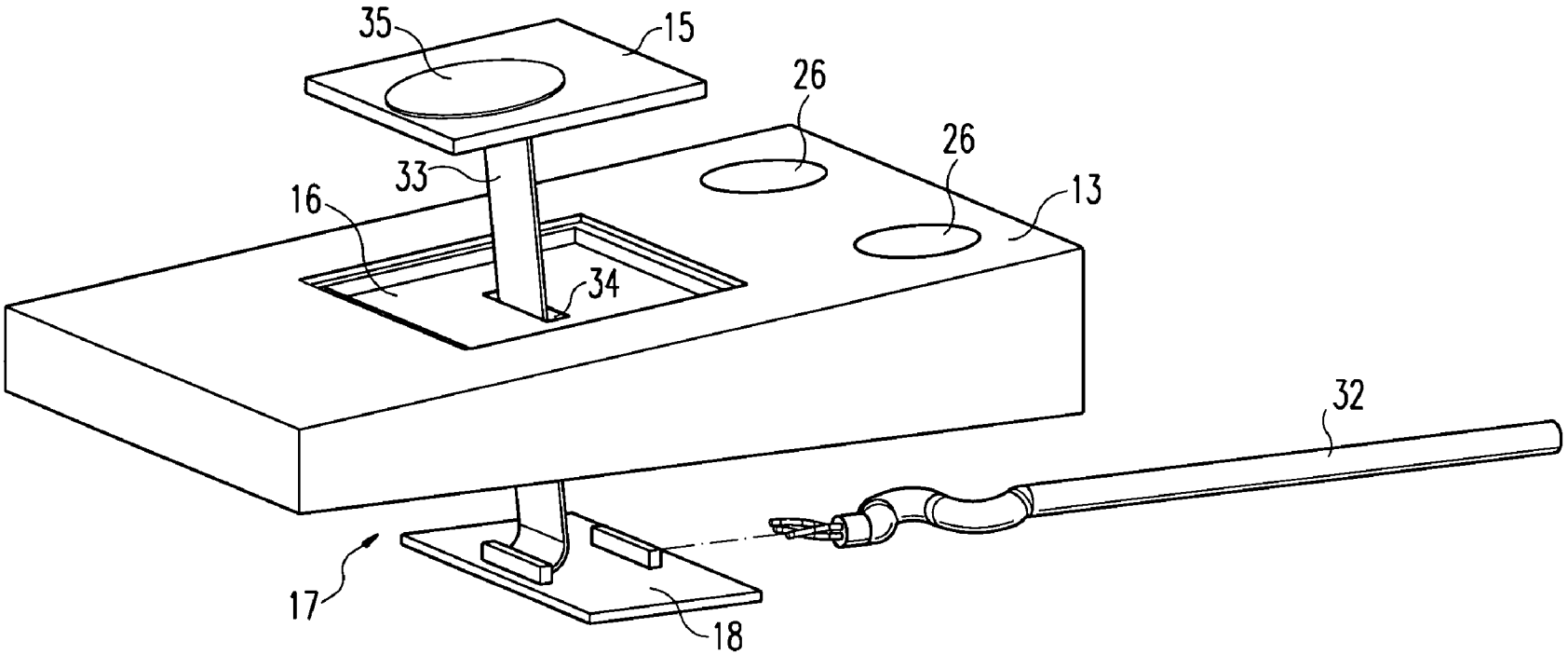
FIG. 8 is an exploded drawing of a floor part with switch element and cable in accordance with a disclosed embodiment.
Figure 9:
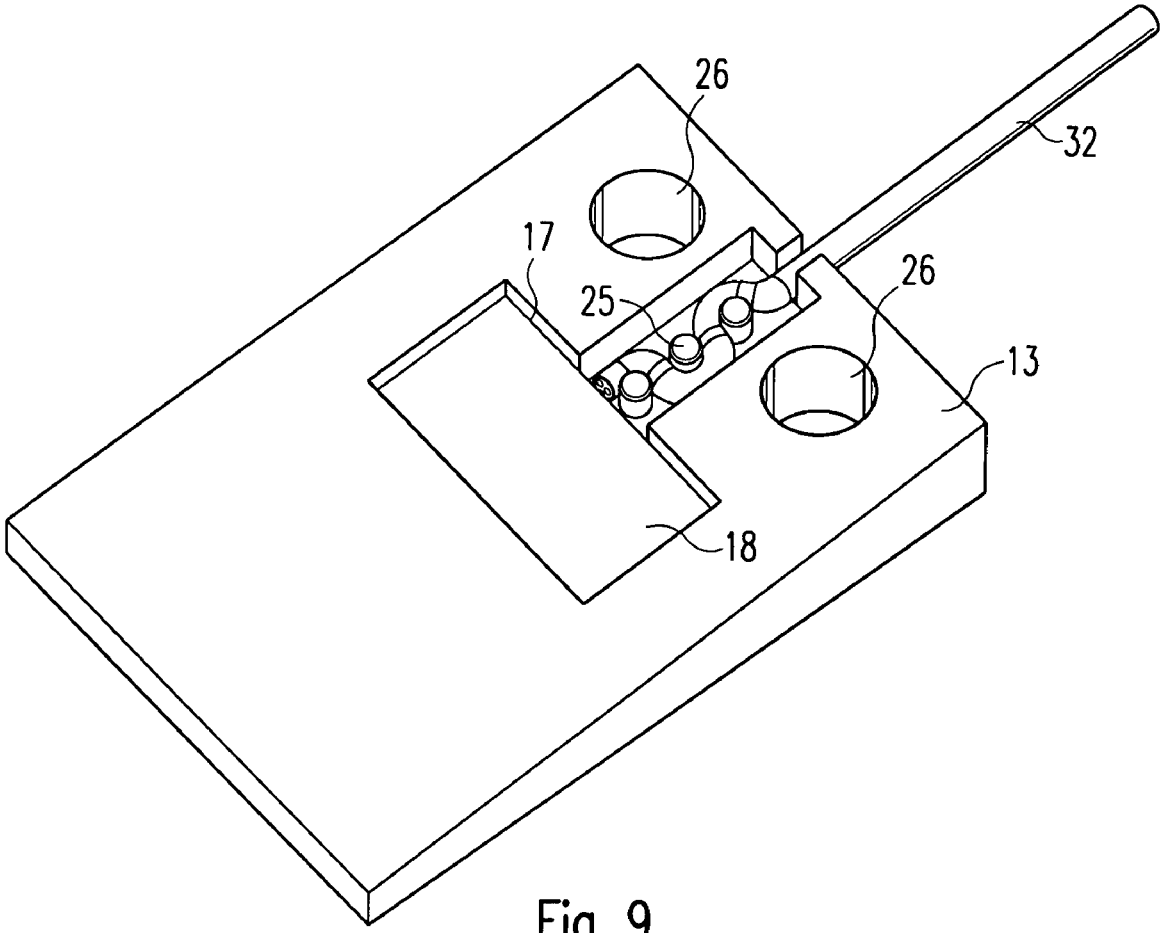
FIG. 9 is a perspective view from below of the floor part according to FIG. 8.

It can be seen in FIGS. 8 and 9 that an opening 26 is formed in the carrier element 13 in the region of each pedal bearing 19. In particular a circular opening 26 is formed. During the extrusion-coating of the carrier element 13, the interior walls of the opening 26 become enclosed by or lined with coating material 14, as can be seen in FIGS. 6 and 7. The openings 26 in the end product constitute ducts through which the connecting means 24, i.e. the screw, is guided into the through-bore 23 in the pedestal 22 and embedded therein.

In addition to the pedal bearing 19 described above, it is also possible to provide a sleeve, in particular an anti-kink sleeve 20, which likewise is formed in one piece with the floor part 10, in particular with the extrusion-coating material 14. The cable sleeve 20 can be adapted to the smallest permissible bending radius of the cable 32, so that this bending limit is not exceeded. This has the advantage that the connecting cable is exposed to less stress due to kinking. Because the foot switch is often removed from the apparatus for washing, and the cable 32 is then wound around the foot switch, the resulting kinking stress is relatively high. The relatively long anti-kink sleeve 20 specifies a relatively large bending radius in the region of the cable connection, so that damage to the cable 32 associated with being wound up is avoided. Because the anti-kink sleeve 20 is formed integrally with the extrusion-coating material 14, the sleeve is not only hermetically sealed but also robustly joined to the housing.

FIGS. 7 and 9 also show that an anti-kink sleeve 20 may be associated with a cable holder 25, which secures the cable 32 against pulling forces. The cable holder 25 is disposed on the side of the carrier element 10 that faces downward when in use, and comprises several, for example three, circular pegs around which the cable 32 meanders. As can be seen in FIG. 7, the cable holder 25 is surrounded by extrusion-coating material 14, which produces an additional fixation of the cable 32.

The floor part 10 further comprises a switch element, arranged and constructed as follows. As can best be seen in FIGS. 6 and 8, a membrane keypad composite 15 with a substantially circular actuation surface or contact surface 35 is provided in a recess 16 on the pedal side, i.e. on the side of the carrier element 13 that faces upward when the actuating device is in use. The membrane keypad composite 15 is connected to evaluation electronics 18 by way of a flexible strip conductor 33. As can be seen in FIG. 8, the strip conductor 33 is guided through a slit 34 in the upper recess 16. The strip conductor 33 is designed as a flat, flexible substrate such as is known in the context of keypads and is guided out of the membrane keypad composite 15 in the middle, on the underside thereof. As a result, a circumferential surface is available for adhesive on the underside of the membrane keypad composite 15, so that the membrane keypad composite 15 can be glued into the recess 16.

The evaluation electronics 18, as shown in FIGS. 6 and 9, are disposed in a recess 17 positioned on the underside of the carrier element 13 while the device is in use.

While the carrier element is being extrusion-coated, an open area is left in the region of the circular contact surface 35 of the membrane keypad composite 15, so that the contact surface 35 remains accessible. The edges of the membrane keypad composite 15 and of the carrier element 13 are additionally sealed during the extrusion-coating process, in order to increase the impermeability of the floor part 10.

On the pedal part 11, in a position opposite the contact surface 35, a projection 36 is formed which, in the resting position, is spaced apart from the contact surface 35. By actuation of the pedal part 11, the projection 36 is pressed onto the contact surface 35 and activates the switch element 12.

The switch element 12 shown in FIG. 6 is marketed under the trade name PushGate™ The advantage of this activation element resides in the fact that switching-cycle values of over $30*10^6$ are possible. Furthermore, this switch element has an especially flat design and therefore is especially suitable for integration into the floor part 10 by an extrusion-coating process. Furthermore, this activation element is mechanically very simple and has a media-tight structure because of the membrane keypad composite.

As an alternative or supplement to this switch element, microswitches, reed contacts and switches with Hall sensors or capacitive and inductive sensors may be used. The non-contact activation elements are of special significance because they make possible a completely closed housing structure. For example, a permanent magnet can be attached to the pedal, which is brought close to a Hall sensor by actuation of the pedal, thus triggering a switching signal. The activation element or switch element 12 shown in FIG. 6, however, offers the advantage over non-contact switch elements that the user receives tactile and audible confirmation that the switching signal has been triggered. Furthermore, there is no need for adjustment to match the switching pathway to the actual time of switching.

It is also possible to employ switch elements having snap disks or switch elements made by the dome-embossing technique. A person skilled in the art will be able to select a suitable switch element depending on the particular application concerned.

With regard to the material, the fact that the floor part 10 can be manufactured by a casting or extrusion-coating process offers the advantage that by selection of a casting material with suitable Shore hardness, the hardness or elasticity of the pedal bearing 19 or of the cable sleeve 20 and of the feet of the device can be optimally matched or adjusted to the particular requirements and structural details of the device in question. If there are different functional requirements, which demand different Shore hardnesses of the casting or extrusion-coating material, or if different colors are to be used for various parts of the product, the casting or extrusion-coating process can also be carried out in several stages, using different materials. For example, it is possible to use a given thermoplastic polyurethane (TPU) in two or more colors, or to use different kinds of TPU, differing for example in their Shore hardness.

Altogether, the fact that the floor part can be manufactured by a casting or extrusion-coating process offers the advantage that a hermetically sealed housing can be produced by extremely simple means, which plays an important role in particular with respect to the demands for washability of the foot switches for an electromedical apparatus. The invention additionally offers the advantage that components provided on the housing, such as the pedal bearing or the anti-kink sleeve, can be produced in one piece with the floor part in the course of the casting or extrusion-coating process. Another significant advantage of manufacturing the floor part by a casting or extrusion-coating process is that no openings are left in the housing that would have to be sealed subsequently, so the relative positions of the pedal parts, regarding their angles and/or distance apart from one another, can be altered with very little structural modification. Furthermore, the alteration of angle and/or spacing is facilitated by the large contact areas of the switch elements.

The invention claimed is:

1. An actuating device for an electromedical apparatus, said device comprising:

a floor part comprising at least one carrier element;

at least one pedal part that is tiltably connected to the floor part;

at least one switch element which is fixed to or within the carrier element, the switch element being actuated by the pedal part;

an extrusion-coating material that at least partially encloses at least the floor part, the extrusion-coating material providing a final shape of the floor part; and a substantially fluid-tight and media-resistant housing that is comprised of either the extrusion-coating material or of the extrusion-coating material and the carrier element, wherein the switch element comprises a membrane keypad composite that is disposed in a recess of the carrier element in such a way that the membrane keypad composite is accessible for actuation by way of the pedal part, and wherein the switch element further comprises a set of evaluation electronics that is connected to the membrane keypad composite and is disposed in an additional recess of the carrier element, the additional recess being situated on a side of the carrier element opposite the membrane keypad composite.

2. The actuating device according to claim 1, wherein a plurality of pedal parts is provided, the pedal parts being disposed in parallel to one another.

3. The actuating device according to claim 1, wherein the carrier element is at least regionally enclosed in the extrusion-coating material in such a way that it substantially matches the contour of the carrier element.

4. The actuating device according to claim 3, wherein the carrier element comprises at least one opening in the region of the tiltable connection between the floor part and the pedal part.

5. The actuating device according to claim 1, wherein the at least one switch element is selected from the group consisting of microswitches, reed switches, switches that include Hall sensors, switches that include capacitive sensors and switches that include inductive sensors.

6. The actuating device according to claim 1, wherein at least one of a pedal bearing and an anti-kink sleeve is formed integrally with the floor part.

7. The actuating device according to claim 6, wherein the anti-kink sleeve is associated with a cable holder that is integrated into the extrusion-coating material.

8. The actuating device according to claim 6, wherein the pedal bearing comprises a pedestal with a bearing surface for the pedal part that is oriented substantially horizontally when the device is in use.

9. The actuating device according to claim 8, wherein the pedestal comprises at least one through-bore which is substantially vertical when the device is in use and serves to receive a connecting means that is used to fix the pedal part to the floor part.

10. A method of manufacturing the actuating device of claim 1, in which the floor part is produced by an extrusion-coating process and wherein the carrier element is at least partially enclosed by the extrusion-coating material and wherein the switch element is fixed to or within the carrier element before the extrusion-coating process.

11. An actuating device for an electromedical apparatus, comprising:

a floor part comprising at least one carrier element;

at least one pedal part that is tiltably connected to the floor part;

at least one switch element which is fixed to or within the carrier element, the switch element being actuated by the pedal part;

an extrusion-coating material that fully coats the floor part, the extrusion-coating material providing a final shape of the floor part; and a substantially fluid-tight and media-resistant housing that is comprised of the extrusion-coating material, wherein the switch element comprises a membrane keypad composite that is disposed in a recess of the carrier element in such a way that the membrane keypad composite is accessible for actuation by way of the pedal part, and wherein the switch element further comprises a set of evaluation electronics that is connected to the membrane keypad composite and is disposed in an additional recess of the carrier element, the additional recess being situated on a side of the carrier element opposite the membrane keypad composite.

12. The actuating device according to claim 11, wherein the at least one carrier element is at least regionally enclosed in the coating material, wherein the coating material conforms substantially to the contour of the carrier element.

13. The actuating device according to claim 11, wherein the at least one switch element is selected from the group consisting of microswitches, reed switches, switches that include Hall sensors, switches that include capacitive sensors and switches that include inductive sensors.

14. The actuating device according to claim 11, wherein a pedal bearing is formed integrally with the floor part and comprises a pedestal with a bearing surface for the pedal part that is oriented substantially horizontally when the device is in use, and wherein the pedestal comprises at least one through-bore which is substantially vertical when the device is in use and serves to receive a connecting means that is used to fix the pedal part to the floor part.

15. The actuating device according to claim 11, wherein an anti-kink sleeve is formed integrally with the floor part and is associated with a cable holder that is integrated into the coating material.

* * * * *